United States Patent [19]

Hahn

[11] 4,196,548

[45] Apr. 8, 1980

[54] SANDING APPARATUS

[76] Inventor: Norman G. Hahn, R.D. 2 Box 68, East Earl, Pa. 17519

[21] Appl. No.: 895,148

[22] Filed: Apr. 10, 1978

[51] Int. Cl.[2] ..... B24B 19/24

[52] U.S. Cl. ..... 51/386; 51/388; 51/241 VS

[58] Field of Search ..... 51/358, 381, 382, 383, 51/384, 386, 388, 241 VS, 241 A, 363, 375, 364

[56] References Cited

U.S. PATENT DOCUMENTS

| | | | |
|---|---|---|---|
| 34,076 | 6/1888 | Riedell . | |
| 1,570,177 | 1/1926 | Pointer | 51/363 |
| 1,951,998 | 3/1934 | Simonson . | |
| 1,953,284 | 4/1934 | Willard | 51/241 VS |
| 1,964,240 | 6/1934 | Beard | 51/241 VS X |
| 2,076,776 | 4/1937 | Hadaway . | |
| 2,085,280 | 6/1937 | Tyler | 51/386 X |
| 2,234,109 | 3/1941 | Culpepper | 51/383 |
| 2,282,650 | 5/1942 | Fenton | 51/375 X |
| 2,294,064 | 8/1942 | Amstuz . | |
| 2,447,102 | 8/1948 | Strand | 51/388 |
| 2,748,547 | 6/1956 | Davies et al. | 51/241 VS |
| 2,842,904 | 7/1958 | Ralys | 51/388 |
| 3,041,795 | 7/1962 | Chick . | |

*Primary Examiner*—Harold D. Whitehead
*Assistant Examiner*—Robert P. Olszewski
*Attorney, Agent, or Firm*—John B. Mitchel

[57] ABSTRACT

Apparatus is disclosed for the surface sanding and fine finishing of contoured workpieces of wood or other similar fibrous material. A rotatable disc-like member having a contoured working surface is provided with surface recesses to accommodate a mating spider which affixes a sheet of abrasive material to the working surface. By matching the contour of the workpiece, rotational contact results in a fine finish, especially in end-grain areas.

4 Claims, 6 Drawing Figures

SANDING APPARATUS

BACKGROUND OF THE INVENTION

This invention relates generally to sanding apparatus, and specifically to apparatus for sanding and finishing the surface of contoured workpieces of wood.

From almost the beginning of recorded history man has used wood to fabricate his most utilitarian household furnishings. In the beginning, each individual fashioned his own projects, but, as society became more complex, select highly skilled cabinetmakers became specialized sources of even the most basic household objects. Though a few of these dedicated craftsmen who construct single special order items can still be found, modern society has become dependent upon the high volume production of quality wooden products which can only be economically attained by modern mass assembly techniques.

Generally, wooden products, even those of a complex nature, lend themselves quite well to elemental mass producttion and assembly; however, the fibrous nature of wood dictates that a fine durable finish can only be applied to a surface which has been sanded with an abrasive material. In most instances, flat surfaces may be machine sanded without much difficulty, but contoured, end-grain, and contoured end-grain areas have in the past required expensive time consuming individual hand finishing by a skilled craftsman. Though much effort has been expended, the invention to be described below is the only known acceptable solution to the economical finishing of the problem areas mentioned immediately above.

SUMMARY OF THE INVENTION

It is an object of the instant invention to provide an apparatus for sanding contoured surfaces of wood or other fibrous workpieces.

It is another object of the instant invention to provide an economical and efficient apparatus for gripping a sheet of abrasive material and finishing the contoured surfaces of wooden workpieces.

It is another object of the instant invention to provide apparatus for fine sanding the end-grain surfaces of a wooden workpiece prior to the application of a finish.

It is a further object of the instant invention to provide apparatus for fine sanding the end-grain surfaces of a contoured wooden workpiece.

The foregoing objects and others are accomplished in accordance with the instant invention by providing apparatus for the surface sanding and fine finishing of contoured workpieces of wood or other similar fibrous material. A rotatable disc-like member having a contoured working surface is provided with surface recesses to accommodate a mating spider which affixes a sheet of abrasive material to the working surface. By matching the contour of the working surface with that of the workpiece, rotational contact results in a fine finish, especially in end-grain areas.

BRIEF DESCRIPTION OF THE DRAWINGS

For a better understanding of the invention, as well as other objects and further features thereof, reference is made to the following detailed disclosure of the invention taken in conjunction with the accompanying drawings wherein.

DESCRIPTION OF THE PREFERRED EMBODIMENT

As will be better understood shortly, the instant invention is directed primarily to a unique concept for the sanding and fine finishing of contoured surfaces of wood or other fibrous workpieces. Basically, the structural elements which embody the invention include a specially designed rotatable disc-like base member and an interfitting spider between which a sheet of abrasive material is gripped to provide an abrasive surface corresponding to the contour of the working surface.

Figure 1:
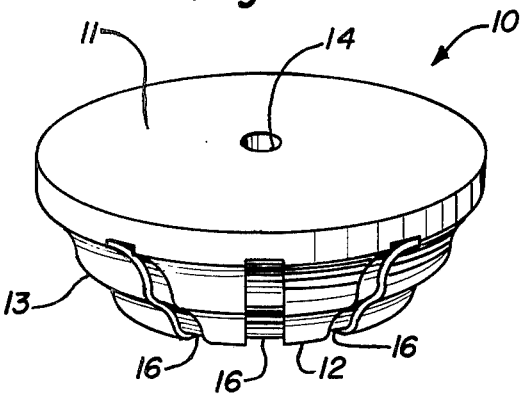
FIG. 1 is a perspective view of the base member of the sanding apparatus of the instant invention.
Figure 2:
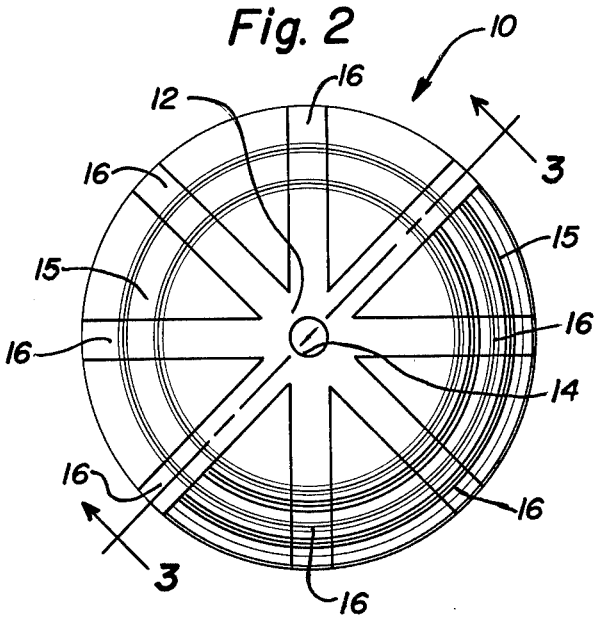
FIG. 2 is a bottom plan view of the member of FIG. 1.
Figure 3:
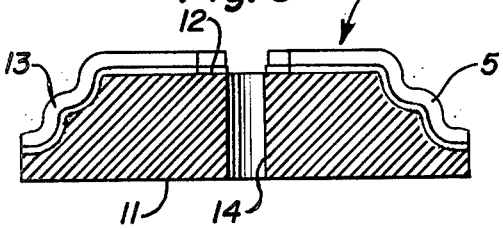
FIG. 3 is a cross sectional view of FIG. 2 taken along line 3—3.

Referring now to FIGS. 1 through 3, the base member 10 can be seen in perspective to comprise a circular top surface 11, a smaller circular bottom surface 12, and a working surface 13 extending therebetween. An axial opening, or hole, 14 extends through the member 10, piercing both surfaces 11 and 12.

The working surface 13 is shown to have a compound contoured configuration which is symmetrical radially about the longitudinal axis of opening 14. The contour of the working surface is very important and is made to conform to the contour of the workpiece, as the two would mate (see FIG. 6). In the preferred embodiment, base member 10 comprises a solid metal structure, such as, for example, aluminum which can be shaped by ordinary machining methods to substantially match the cutter which initially formed the workpiece.

As perhaps best seen in FIG. 2, the base member has a plurality of recesses 16, not all of which are numbered in the Figs., cut into the working surface thereof and extending from the bottom surface 12 toward the top surface 11. It is preferred, though not necessary, that recesses 16 be rectangular in cross section and substantially of constant depth or spacing from working surface 13. Recesses 16 in effect divide the working surface 13 into a plurality of segments 15 (only two of the eight segments shown in FIG. 2 being identified). These segments, when layered with a resilient material 5 (see FIG. 3) of approximately ⅛ inch thickness to absorb impact, form the foundation upon which the abrasive sheet rests.

Figure 4:
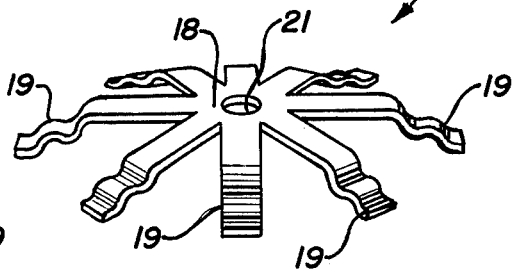
FIG. 4 is a perspective view of the spider which affixes to the base member of FIGS. 1–3.

FIG. 4 shows a spider, or holding member, 17 in perspective which mates with the recesses 16 on base member 10. More specifically, spider 17 comprises a central flat portion 18 with depending legs 19 extending downwardly away therefrom. Each leg 19 is shaped to correspond to the contour of the recesses, such that placement of central portion 18 on bottom surface 12 of the base member causes the legs to fit precisely in the respective recesses. The depth of recesses 16, and the thickness of legs 19 are such that the legs are well below the working surface when a sheet of abrasive material is interposed therebetween. Central portion 18 is also provided with an opening 21 which may be aligned with opening 14 in the base member. Spider 17 is preferably made of a resilient material such as spring steel, whereby the legs thereof may be slightly biased, in the assembled format, toward recesses 16 to firmly grip the abrasive sheet. Any constructional material which will permit this function is suitable.

Figure 5:
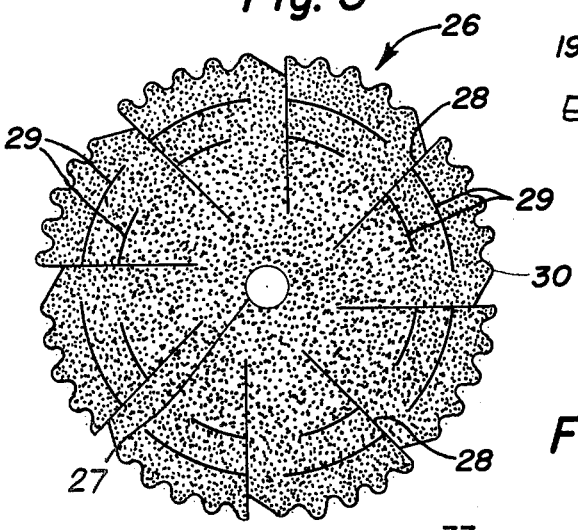
FIG. 5 is a plan view of a sheet of abrasive material formed to fit on the base member of FIGS. 1–3.

Ideally, the assembled apparatus will have an abrasive surface corresponding to working surface 13, and not have folds or other surface irregularities in the abrasive sheet. In order to accomplish this and still use flat, non-contoured abrasive sheets, the sheet must be precut to properly fit the gripping apparatus. FIG. 5 shows an abrasive sheet 26 cut in a circular pattern with a hole 27 in the middle thereof. In use, hole 27 aligns with openings 14 and 21. A series of spaced cuts 28 are formed in the sheet 26 to extend inwardly from the periphery. Further cuts 29 extend from cuts 28 in a semi-circular direction therefrom. The objective in sheet cutting is to eliminate the possibility of sheet buckling upon assembly and during use. The number of spider legs 19 and cuts 28 and 29 is dependant upon the diameter of the base member 10 and the contour of working surface 13. The larger the diameter of the base and the more complex the contour, the more legs and cuts that are required. Cuts 28 correspond directly with the legs 19. Cuts 29 are positioned and selected to overlie breaks in the surface 13. Additionally, edge 30 is cut in an undulating pattern so that it may conform to the outer edge of base member 10.

Assembly of the spider, abrasive sheet and base member is accomplished by simply interfitting the spider in recesses 16 with the sheet therebetween. Each leg 19 overlies a cut 28 but holdingly engages only that edge adjacent the preceeding lateral cuts 29. Thus, between each leg 19 there is a flap of abrasive sheet material which is free to conform to the working surface, or, in other words, each segment 15 without buckling.

Figure 6:
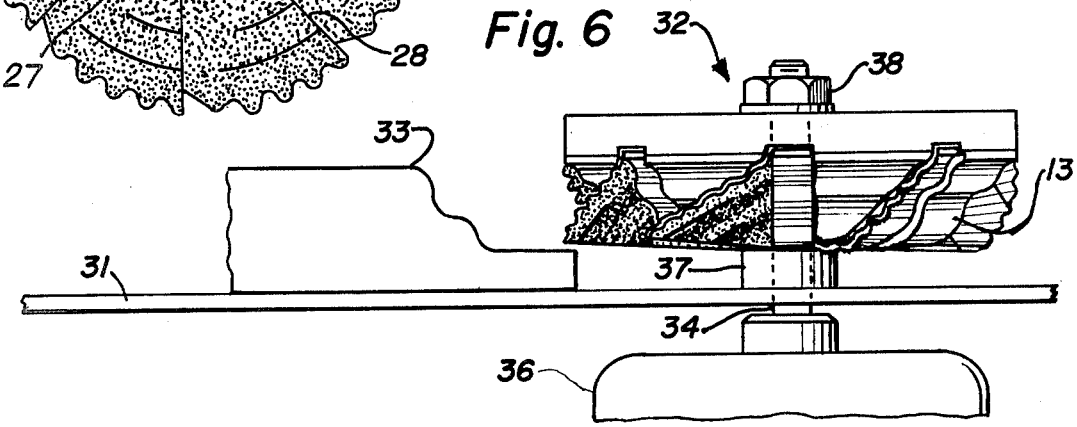
FIG. 6 is a schematic side elevational view of the sanding apparatus of the instant invention as it would appear during use.

In operation, the apparatus is assembled substantially as schematically shown in FIG. 6. A rigid substantially planar surface 31 is used to support the assembled sanding device 32 and the workpiece 33. As can be seen, working surface 13 is substantially the same as, though reversed, that portion of the workpiece to be sanded. A shaft 34 is driven by any suitable means, such as, for example, motor 36, and extends through surface 31, a spacer 37, hole 21 in spider 17, hole 27 in abrasive sheet 26, and opening 14 in base member 10. Spacer 37 may be a washer-like member or, more advantageously, a ball bearing which stops its relative rotation with shaft 34 when contacted by the workpiece. Spacer 37 is substantially the same diameter as central portion 18 of spider 17. A nut 38 threadably affixes to shaft 34 to hold the structural elements together in a rigid fashion. As the sanding device is rotated, the workpiece is moved into moving contact therewith to provide the desired result. Here it should be noted that one of skill in the art will be able to devise several alternative table/drive arrangements which will prove operable. For example, the table may be vertically adjustable or extra spacers may be added to accommodate different workpieces. Any suitable rotational speed may be aplied to the sanding device, depending upon the workpiece material and the abrasive used. Also, any suitable dimensions may be used for base member 10 and the various other elements and component variables. One of skill in the art will readily appreciate the applicable ranges of these parameters.

It will be understood that various changes in the details, materials, and arrangements of parts, which have herein been described and illustrated in order to explain the nature of the invention, will occur to and may be made by those skilled in the art upon a reading of the disclosure within the principles and scope of the invention.

What is claimed is:

1. Sanding apparatus for rotational contact with, and the fine finishing of, a compound contoured workpiece of wood or other fibrous material, said apparatus comprising:

a disc-like base member having a substantially circular top surface, an opposing substantially circular bottom surface, a working surface extending between the peripheries of said top and bottom surfaces, and a first axial opening extending between said top and bottom surfaces about which said working surface is substantially radially symmetrical;

said working surface being compound contoured, varying radially along the axis of said first opening between said top and bottom surfaces to substantially match the contour of the workpiece and including a plurality of spaced apart recesses extending from said bottom surface toward said top surface, said working surface having a thin layer of resilient material affixed thereon, exclusive of said recesses;

a spider having a central portion with a second opening therethrough and a plurality of legs extending away therefrom corresponding to said recesses;

a generally circular sheet of abrasive material with a circumferential edge and a third opening in the center thereof, said sheet of abrasive material having a plurality of equally spaced straight line slits therein corresponding in number to said legs of said spider and extending inwardly from said circumferential edge, each said straight line slit forming first and second opposing edges, said sheet of abrasive material further having a plurality of arcuate slits therein, each of said straight line slits being intersected by at least one of said arcuate slits, said arcuate slits extending from the first edge of the respective straight line slit toward, but not to, the second edge of the adjacent straight line slit;

said sheet of abrasive material being positioned on said working surface and held thereagainst by said spider, said first, secnd and third openings being in alignment and each said spider leg clamping the second edge of one of said straight line slits in the respective recess in said base member so that the first edge of said straight line slit is free to conform to said working surface; and means extending through said first, second and third openings to hold said base member, said abrasive sheet and said spider together.

2. The apparatus of claim 1 wherein said spider is dimensioned to bias the legs thereof into said recesses.

3. The apparatus of claim 2 wherein said resilient material is rubber.

4. The apparatus of claim 3 wherein said resilient material is about ⅛ inch in thickness.

* * * * *